United States Patent [19]

McKee

[11] 4,035,049

[45] July 12, 1977

[54] UNIVERSAL SOLDERLESS TERMINATION SYSTEM

[75] Inventor: William H. McKee, West Covina, Calif.

[73] Assignee: TRW Inc., Elk Grove Village, Ill.

[21] Appl. No.: 656,866

[22] Filed: Feb. 10, 1976

[51] Int. Cl.[2] ..... H01R 9/08

[52] U.S. Cl. ..... 339/97 R; 339/223 R; 339/258 R

[58] Field of Search ..... 339/96, 97 R, 97 P, 339/98, 99 R, 223 R, 176 M, 176 P, 103 M, 256 R, 258 R, 258 P, 262 R; 174/88 R

[56] References Cited

U.S. PATENT DOCUMENTS 3,950,065 4/1976 Renn ..... 339/98

*Primary Examiner*—Francis S. Husar
*Assistant Examiner*—Mark Rosenbaum
*Attorney, Agent, or Firm*—Neuman, Williams, Anderson & Olson

[57] ABSTRACT

Disclosed is a solderless termination system for multi-contact electrical connectors. The termination system generally includes an elongated U-shaped channel of thin conductive sheet metal having one or more tabs extending from the upper edges of the sidewalls which are shaped and folded into the channel to define smooth and substantially rigid constrictions for rupturing and separating the insulation from a wire inserted into the channel and thereafter establishing and maintaining electrical contact with the underlying conductor. The tabs are formed so as to present a smooth, tapered lead-in region having a rigid rounded nose. The nose provides a smooth transition toward a curved wiping surface extending vertically downward toward the floor of the channel, the lower portions of the tabs being retained in or near the floor of the channel to prevent flexing of the tabs in the face of axial forces upon the inserted wire.

22 Claims, 11 Drawing Figures

FIG. 1
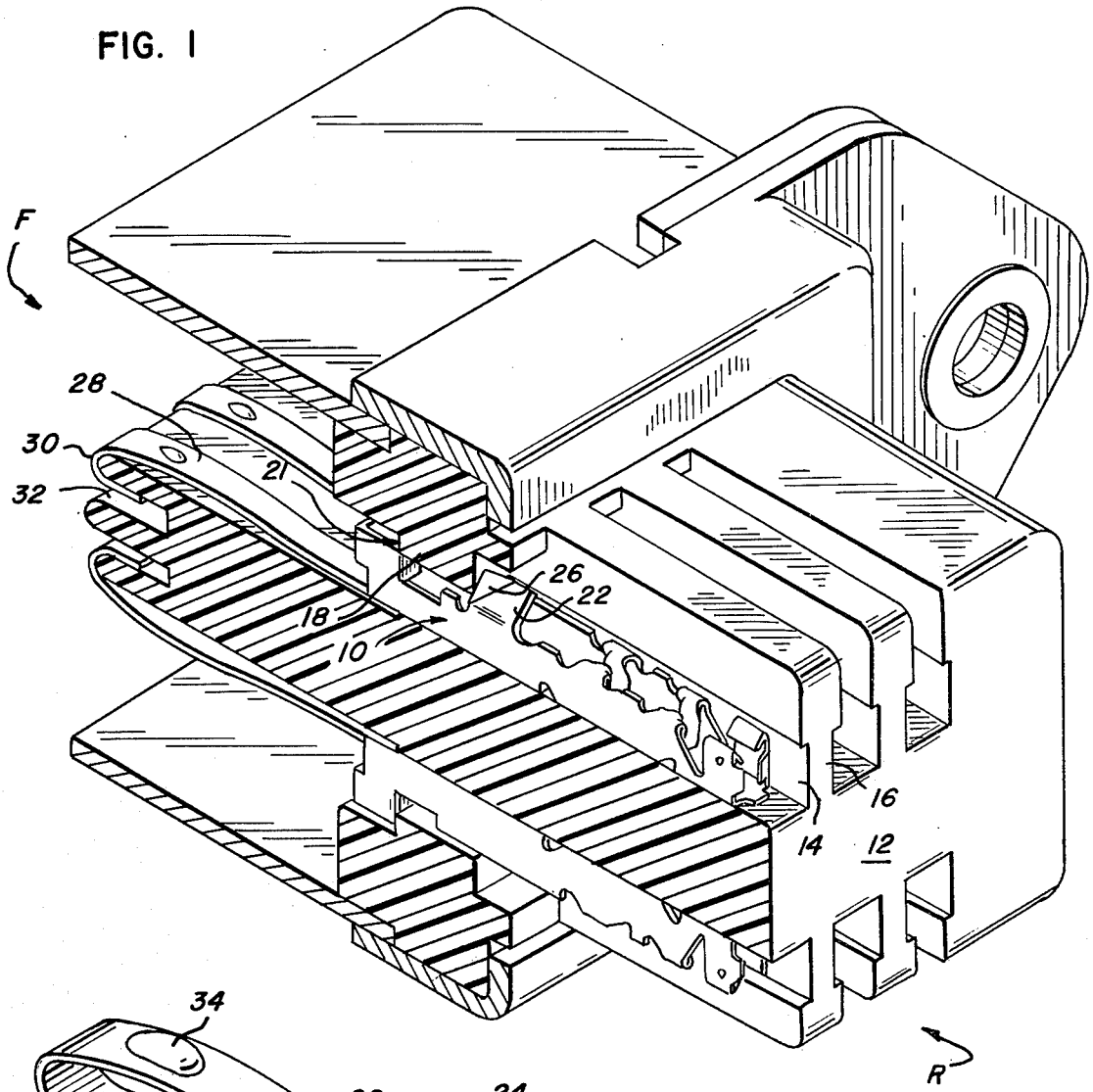
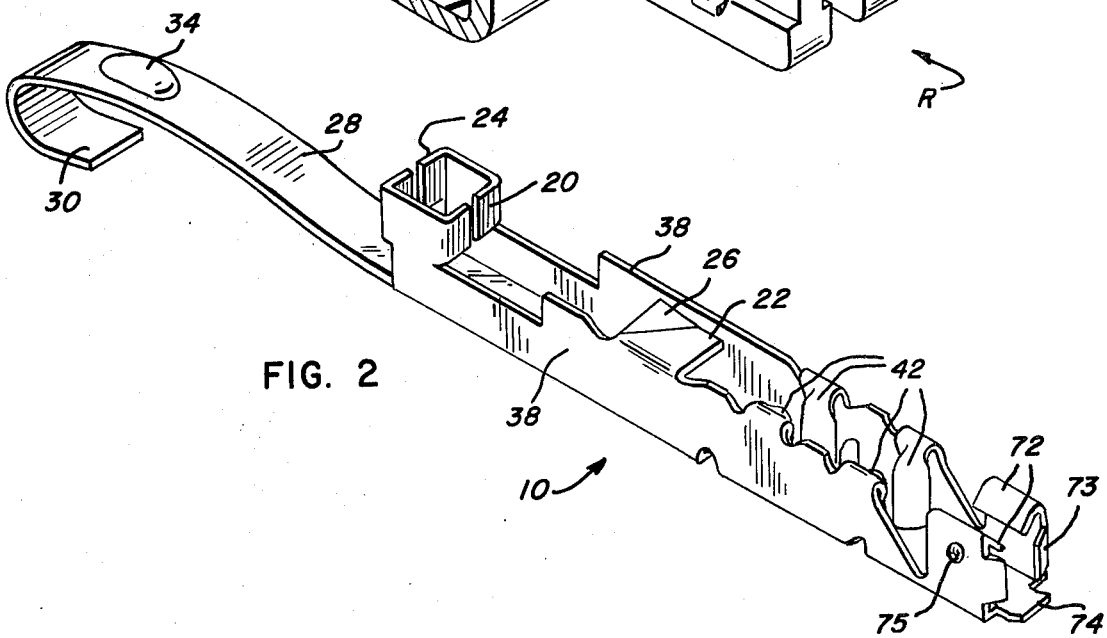
FIG. 2

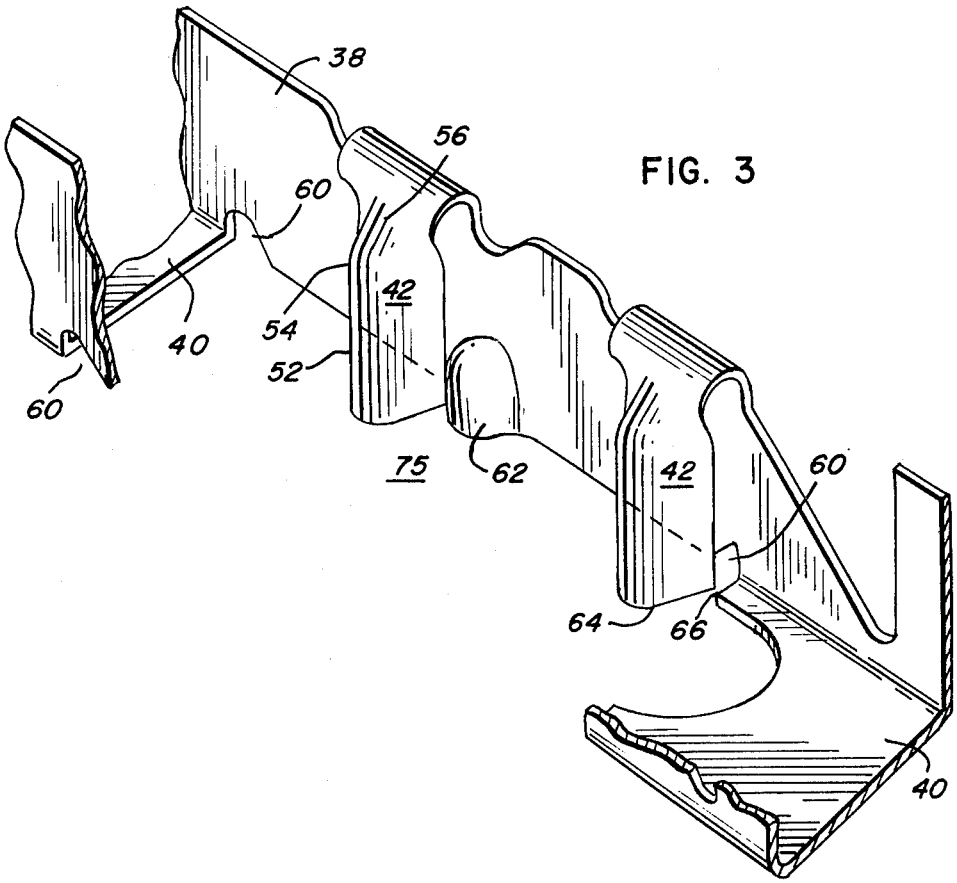
FIG. 3
FIG. 4
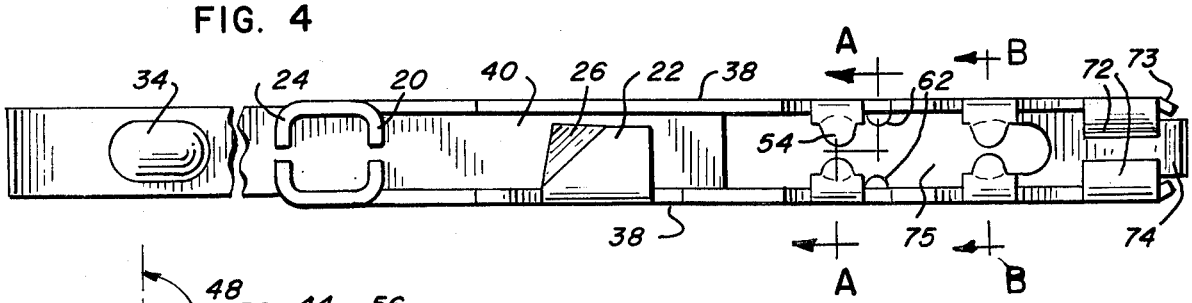
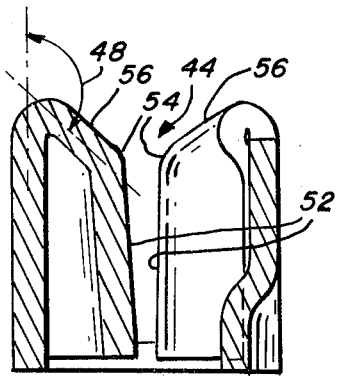
FIG. 4A
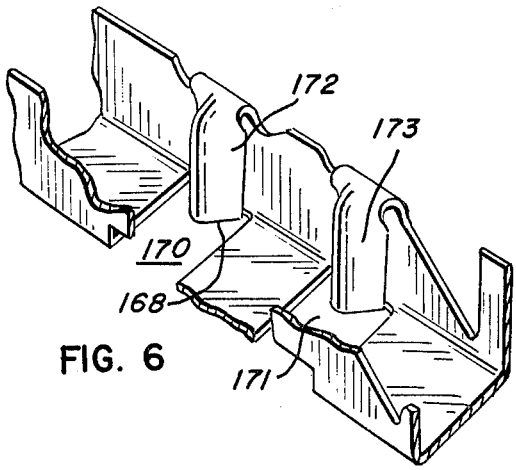
FIG. 6

UNIVERSAL SOLDERLESS TERMINATION SYSTEM

BACKGROUND OF THE INVENTION

1. Field of the Invention

This invention relates to a solderless termination system for contact elements in electrical connectors. In particular, it relates to such a system in which thin conductive sheet metal is formed into a wire receptacle adapted for rupturing the insulation of a wire upon insertion and engaging and holding the underlying conductor.

2. Description of the Prior Art

Multiple-wire termination systems have come into extensive use in the government electronics and telecommunications industries. These termination systems are widely used in commercial connectors having fifty contact members, more or less, arranged in parallel adjacent rows. The contact elements are recessed into elongated passages formed in a dielectric contact mount and are of sheet metal shock having one end thereof formed into a U-shaped wire receiving channel or receptacle. Termination systems of this type are used for splicing wires as well as for terminating wires in connectors.

Originally most such termination systems were of the type in which bare conductors are soldered into U-shaped channels of conductive sheet metal. These solder-type connectors required high-temperature dielectric materials and substantial manual labor or elaborate machinery for inserting and soldering the conductors into place. As a result, a number of solderless versions of the channel-type termination have been devised, some of which have proven capable of meeting the rigid performance demands normally placed on such terminations. Particularly in high density applications, severe design and performance specifications must be met. For example, contact resistance must be minimized and must remain quite constant over a range of environmental variables and time. Also, physical strength and economy of manufacture must be maximized.

Ease of manufacture has dictated the use of thin conductive sheet metal as the material for a large number of termination systems of both the solder and solderless type. This material, typically cadmium bronze of 0.006 inches thickness, can be rapidly fed in a long continuous ribbon through the desired stamping and forming operations. Manual steps are few, if any, and metal waste can be carefully controlled. Several solderless termination systems heretofore known in the art have incorporated the thin, relatively sharp edges possessed by the metal stock itself as cutting edges for piercing and separating the insulation from the conductor as it is inserted into the termination end of the contact element. The metal is easily formed into opposing blades or jaws converging into the channel to define a lead-in area to provide convenient positioning and gradual gripping of the wire upon insertion.

For example, the copending application Ser. No. 443,678 of William McKee and Roy Witte discloses a termination system made from thin conductive sheet metal and having sidewall portions which are formed in and slit to define a tapered lead-in area at the upper entrance to the channel. The lead-in area has exposed metal edges which effectively pierce and separate the insulation from the conductor upon its insertion into the channel. Between the lead-in area and the vertical contact wiping surfaces is a gradual transition area that results from coining the inner edges of the formed-in sides.

Solderless termination systems of the type described above are effective in piercing and separating the insulation from insulation covered conductors by virtue of the sharp cutting edges which they possess in the lead-in area of the channel. However, the sharpness of the cutting edges presents a hazard to wires which are inserted slightly off-center of the channel in that severe scoring or cutting of the underlying conductor can take place before final contact is achieved. Even if the conductor remains axially intact, the effective point-contact area, as well as the gripping pressure between the jaws and the conductor, can be seriously diminished. In particular, the termination systems described above have severe limitations in connectors for terminating multiple-strand insulated wires. The individual conductors or strands found in such wire are extremely small in size and are easily pierced or broken unless adequate precautions are taken. Furthermore, the strands, by their very nature, move independent of one another and, as such, are collectively more easily deformed upon insertion into the channel than is a solid conductor of comparable guage. As a result, the conductor-to-contact pressure of the termination is substantially less than for solid wire terminations.

The termination system of the present invention overcomes the aforesaid limitations residing in the prior art devices in that it operates without the use of flat, sharp cutting edges which can score and damage solid conductors or sever the individual strands of stranded wire.

SUMMARY OF THE INVENTION

The termination system of the present invention is similar to existing designs in that it incorporates a generally U-shaped channel structure formed of thin conductive sheet metal. This channel design makes the present system compatible with the existing multi-contact mating-type connectors which include a molded dielectric contact mount with the plurality of contact-receiving passages extending therethrough. However, extending from the top or upper edges of the metal sidewalls are one or more tabs which are folded downward and taper into the channel to provide a lead-in area and wiping surface for the inserted conductor. The tabs are shaped vertically to provide a curved wiping surface as well as a rounded nose or transition area between the lead-in portion of the tab and the wiping surface. The curvature of the nose provides substantial rigidity in the transition area and imparts to the tabs a capability to rupture and separate the insulation from an inserted wire without cutting away the conductor, or in the case of stranded wire, without cutting or severing the strands. The bottom of the channel is partially cut away to accept the lower end of the folded tab and to hold the tab against axial movement under stress on the wire. Alternate embodiments are also shown which include other means for holding the tab to prevent axial movement thereof.

The folded tab construction with its rounded nose and wiping surface provides a high degree of structural rigidity while being adaptable to both solid and stranded wire conductors. The contact design provides for ease and economy of manufacture.

Other advantages of the invention will become apparent from the following detailed description and upon reference to the drawings.

BRIEF DESCRIPTION OF THE DRAWINGS

FIG. 1 is a perspective sectional view, partially cut away, of a multi-contact electrical connector constructed in accordance with the present invention.

FIG. 2 is a perspective view of a contact member shown in FIG. 1.

FIG. 3 is a partially cut away perspective view of the wire termination portion of the contact member shown in FIG. 2.

FIG. 4 is a plan view from the top of the contact member shown in FIG. 2.

FIG. 4A is a cross-sectional view taken along the lines A—A of FIG. 4.

FIG. 6 is a perspective view of the termination system, partially cut away to illustrate a further embodiment of the axial restraint means of the present invention.

Figure 5A:
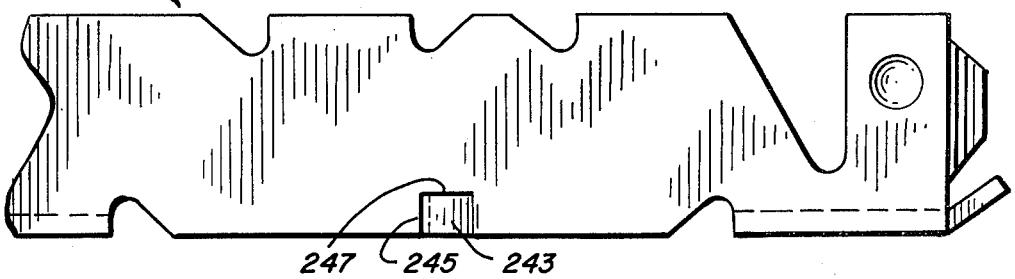
FIGS. 5 and 5A are views from the bottom and side, respectively, of an alternate embodiment of the axial restraint means and tab form of the present invention.

Turning first to FIG. 1, there is shown a portion of a male connector of multi-contact design having a rearward end R, for receiving and holding (i.e. terminating) a plurality of conductors such as in a multi-conductor cable, and a forward end F, for electrically and mechanically mating the connector to a similarly constructed female connector containing a complementary receptacle. The terms "forward", "rearward", "top", "bottom", and "floor", as used herein, are relative terms used for descriptive purposes only. It will be appreciated that even within a single connector there are contact members disposed in opposite senses so that a floor may be physically either up or down to a viewer.

Connectors of this general type facilitate the connection of large numbers of wires, typically 50 or more, carried by a harness (not shown) and terminated to contact members mounted in parallel rows of oppositely disposed channels or slots formed in a non-conductive connector housing.

To this end contact members 10 are mounted within a connector housing 12 of insulating dielectric material in slots 14 formed at the wire termination end of the connector. These slots are defined by the main connector housing block 12 and ribs 16 protruding therefrom. For securing the contact member in place an overhang 18 is provided extending between the ribs 16 over the top of the slot 14. This overhang 18 abuts against protrusions on the contact member 10 as is more fully discussed below.

Each contact member 10 is formed to include a mating portion and a wire termination portion. Typically, the contact member is formed from 0.006 inch thick cadmium bronze sheet metal which is gold plated at points of electrical connection to avoid corrosion. Intermediate its mating and termination portions, the contact member 10 is provided with locking means for axially restraining the contact member 10 after insertion from the forward end F of the channel. More particularly, stop shoulders 20, folded in from the sides of the contact member to a position transverse to its longitudinal axis, abut the forward edge 21 of the overhang 18. A locking tab 22 is folded across the wire termination channel (FIG. 2) from one sidewall thereof and contains a reverse bend 26. After insertion of the contact member 10 into the slot 14, the locking tab 22 is bent upward, as shown in FIG. 1, to lock the contact member in the slot.

At the forward end of the contact member is a blade 28 having a curved end 30 which is hooked into a retaining groove 32 in the mating end F of the connector insulator. During the contact insertion process the bend 26 of the tab 22 engages the forward end of the overhang 21, limiting the free movement of the contact. Continued insertion is then made while aligning the curved end 30 of the blade 28 into the retaining groove 32. In its final position, the blade presents an upwardly bowed spring contact for achieving electrical connection with a complementary connector exhibiting a similar downwardly bowed contact. Coupling of complementary male and female connectors causes opposing blades to deflect one another to achieve a tight physical contact. The resulting high contact pressure minimizes corrosion of the contact surface and also provides a wiping action across the contact surface of the blade 28 to maintain a clean surface as the connectors are engaged and disengaged.

Increased contact pressure may be obtained by providing a tighter curve in the blade end of the contact member 10, and, additionally, by causing the blade end to be pre-loaded against the retaining groove 32 of the connector housing. In this manner, secure electrical connections with minimized contact resistance are provided due to the intimate contact thereby achieved. These characteristics may be further enhanced by providing a raised portion 34 on the blade 28 to obtain an interference fit when engaged with a complementary connector and to assure continued contact wiping pressure during engagement and disengagement of the connectors.

The construction of the wire termination portion of the contact member 10 may be seen most clearly by reference to FIGS. 2 and 3. Forming the main body of the wire termination portion are two sidewalls 38 and a floor 40 connecting these sidewalls to form a generally U-shaped channel. (In the following description, the edge of the sidewalls 38 furthest from the floor 40 is described as the top edge.) The wire termination function is performed by pairs of tabs 42 integral with the top edge of the sidewalls and bending down to form jaws in the channel area.

Each pair of tabs 42 defines opposed jaws, one on each side of the channel. Multiple tab pairs in each channel are desirable to enhance the overall performance of the termination system. The jaws may be formed by performing basically two bending operations on the tabs. First, the tab 42 is shaped or formed along its vertical centerline to form a curved wiping surface 52. Then the tab is turned down into the channel area.

Figure 8:
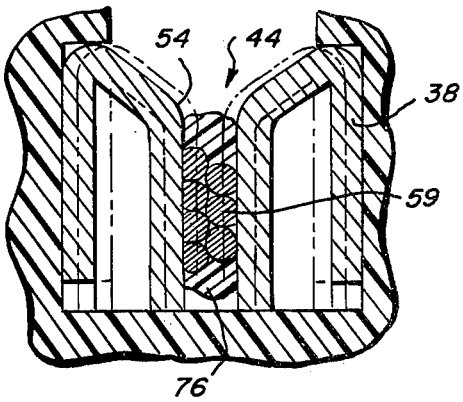
FIG. 8 is a cross-sectional view similar to FIG. 7 but showing the placement of a stranded wire between the wiping surfaces.

In accordance with the present invention, the tabs are formed or bent such that the gap between oppositely disposed jaws is substantially narrower than the diameter of the wire as well as the underlying conductor so that substantial contact pressure is imparted to the wire upon its insertion into the channel. These closely spaced jaws are especially suitable for use with stranded wire, where the thin strands initially arranged in a circular formation tend to distort into an oval formation spreading over the length of the jaw wiping surface (FIG. 8). In the preferred embodiment, the gap is slightly tapered to narrow toward the floor of the channel (see FIG. 4A). This tapering aids in uniformly distributing contact pressure upon an inserted wire.

As shown in FIGS. 3 and 4A, the aforesaid process of forming the tabs 42 from the sheet metal results in a bend 48 adjacent the channel sidewall which is greater than 90°. This results in a downward incline 56 in the lead-in area 44 which acts as a wire insertion guide. The wiping surface 52 joins the incline 56 at less than 90°, resulting in a nearly vertical jaw in the area of the wiping surface 52. As a further result of the bending process, the transition area between the tapered incline 56 and the wiping surface 52 is in the form of a smoothly rounded nose 54 having substantial structural rigidity sufficient to rupture and separate the insulation from the conductor upon insertion of the wire into the channel (see FIGS. 7 and 8).

For retaining the jaws in their original alignment in the face of axial forces tending to pull the wire out of the channel, there is provided restraining means in the form of an inward protruding dimple 62 adjacent the rearward edge of each crimped tab (FIGS. 3 and 4). An axial force on the conductor dislodges the tab 42 only to the extent that it abuts the protruding dimple 62. In the embodiment shown in FIGS. 3, 4 and 4A, a restraining dimple 62 is only shown near the forward jaw. The rearward jaw may be held axially by a similar dimple or alternatively, as shown, by extending the lowermost edge 64 of each shaped tab below the floor level in the cut-out region 75. A rearward axial force on the inserted wire causes the jaw to shift, if at all, only until it abuts against the floor edge 66.

An alternate form of axial restraint is shown in FIG. 6, wherein the floor of the channel is selectively stamped or cut to define two separate cut-out areas 170, 171 for receiving and holding the ends of the shaped tabs 172, 173 respectively so as to secure them from axial movement.

Figure 5:
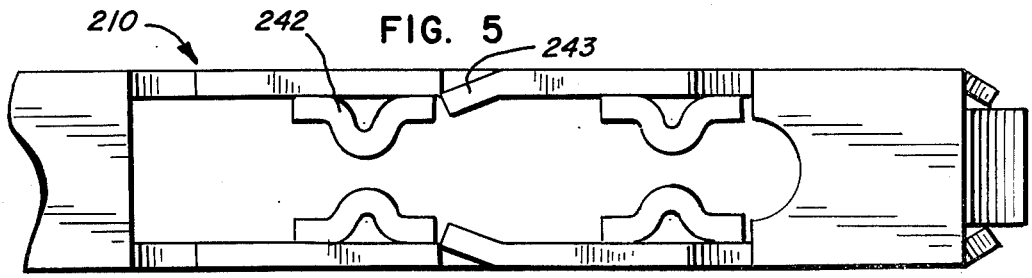

A further alternative for the axial restraint is shown in FIGS. 5 and 5A (bottom and side views, respectively) where the contact member 210 includes a notched portion 243 protruding inward from the bottom of the sidewall adjacent the tabs or jaws 242. Although both forward and rearward jaws may be secured by these notched portions, it is preferable to secure the rearward jaws with the floor edge as previously described.

Figure 9:
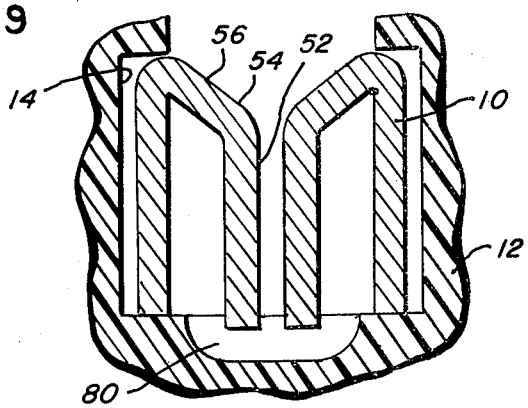
FIG. 9 is a cross-sectional view of the wiping surfaces of FIGS. 7 and 8 showing an alternative embodiment of the connector housing.

As noted in FIG. 3 and discussed above, the elimination of the floor area in the vicinity of the jaws 42 provides a cavity having an edge 66 for securing the lower end of the folded tab and thus preventing axial movement of the jaw 42. A further benefit is derived from this recession in the floor of the channel in that it allows for deeper insertion of the conductor and its associated insulation. The wire conductor may thus be inserted further into the channel than when the floor is present and, accordingly, the conductor is exposed to an effectively longer wiping surface. The effective depth of the channel may be still further increased in the manner shown in FIG. 9, in which a trough 80 is shown formed in the connector insulator 12. This trough lies axially along the bottom of the notch 14 and is positioned so as to lie adjacent the open area in the metal floor of the contact element 10. Insulation forced downward below the inserted conductor is thus allowed to flow out of the immediate vicinity of the wiping surfaces 52 into the trough 80. The effective increase in channel depth thus achieved is particularly significant in applications involving stranded wire, where the deformation results in a substantially increased vertical contact area between the strands of wire and the wiping surface 52.

Figure 7:
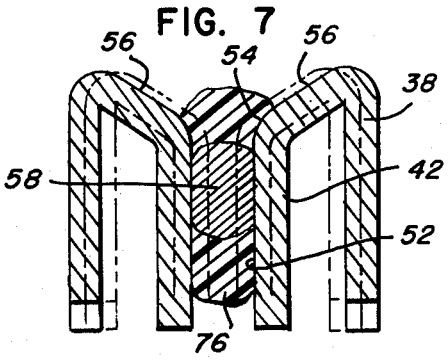
FIG. 7 is a cross-sectional view of the contact member taken along the line B—B of FIG. 4 showing the placement of a solid core wire between the wiping surfaces.

The operation of the aforesaid solderless termination system with solid wire is shown in FIG. 7, while the system's performance with stranded wire is shown in FIG. 8. Turning first to FIG. 7, it is seen that insertion of the wire into the channel ruptures the insulation 76 and separates it from the underlying conductor 58 as the wire passes over the transition area or rounded nose 54. The conductor 58 is deformed. As a result of this deformation the contact area between the conductor 58 and the wiping surfaces 52 of the jaws 42 is increased. The position of the jaws 42 prior to insertion is depicted by the broken lines shown in FIGS. 7 and 8. During insertion these jaws remain substantially rigid in relation to the sidewalls of the contact member 10. However, as the wire insertion process takes place, both the sidewalls 38 and the wiping surfaces 52 yield laterally to a limited extent (depending on the thickness and hardness of the conductor) due to the open floor area in the region of the jaw. The gap between the jaws may expand until the sidewalls 38 abut the sides of the slot 14 in the insulator 12 at which point the pressure tending to deform the conductor 58 increases substantially.

A similar result is obtained with the use of stranded wire, as shown in FIG. 8. As the wire is inserted into the lead-in area 44, the insulation 76 is ruptured by the opposing noses 54 and separated from the underlying strands 59. Due to the smoothness of the noses 54 in the transition area, the strands remain intact, with only slight deformation of any individual strand. As the wire is inserted further into the channel, however, and particularly after the sidewalls 38 have expanded to fill the slot 14 in the insulator, the pressure exerted by the wiping surfaces 52 on the wire causes the individual strands 59 to reorient themselves in a generally vertical direction, increasing the effective contact area between the wiping surfaces 52 and the conductor 59.

The substantial rigidity of the jaws 42, together with the limited flexibility of the adjoining sidewalls, makes the termination system described above a truly universal system, capable of performing well with both solid and stranded wires of varying guages. Light gauge or soft solid wires, like stranded wires, will be deformed upon insertion. If the wire lacks the hardness of structural rigidity to separate the jaws 42, it will nevertheless be effectively terminated due to the enlarged contact area resulting from its deformation.

In addition to the clamping action provided by the contact jaws upon the conductor itself, additional holding means are provided at the rearward end of the end of the channel to protect the wire and its surrounding insulation from dislodgement from the channel. More specifically, in the embodiment shown in FIGS. 2 and 4, tabs 72 are folded into the channel from the top of the sidewalls at the rear of the contact member. A dimple 75 below the tabs 72 restricts the flexing of the tabs 72 upon insertion of the wire into the channel and thereby distributes the insertion forces to the sidewalls themselves, resulting in a tendency for the tabs 72 to return to their original position after insertion of the wire and thereby restrain the insulation from further movement.

While particular embodiments of the invention have been shown, it will be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

I claim:

1. An electrical connector for interconnecting a plurality of insulation covered electrical conductors comprising an insulating housing and a plurality of contact elements of thin sheet metal construction mounted in the insulating housing, each contact element having a mating portion and a conductor termination portion, said termination portion including:

a pair of sidewall sections and a floor extending substantially therebetween to define an elongated channel;

at least one tab integral with and extending from the top edge of one of said sidewall sections, said tab being folded inward along said top edge and extending down toward said floor to define a contact jaw in said channel for electrically engaging a conductor inserted into the channel.

2. The electrical connector of claim 1 wherein said tab has a free end adjacent said floor, said termination portion further including means restraining said free end against movement within said channel.

3. The electrical connector of claim 2 wherein said floor includes a cut-away portion and wherein said folded tab extends down into said cut-away portion to provide said restraining means.

4. The electrical connector of claim 1 wherein said tab is vertically shaped to define a curved contact surface and a pair of wall sections extending outward from said curved contact surface toward the adjoining sidewalls.

5. The electrical connector of claim 1 wherein said tab has a tapered surface converging downward from the top of said sidewall and a contact surface extending vertically in generally parallel relation to said sidewalls for engaging said conductor upon insertion.

6. The electrical connector of claim 5 wherein said tab further includes a smooth rigid transition area between said tapered surface and said contact surface for rupturing and separating the insulation from said electrical conductor upon insertion thereof into said channel.

7. The electrical connector of claim 2 wherein said restraining means includes a notched portion bent inward from said sidewall adjacent the free end of said tab so as to restrain movement of said tab axially within said channel.

8. The electrical connector of claim 6 wherein said transition area comprises a curved nose.

9. The electrical connector of claim 4 wherein said tab further includes a tapered lead-in surface adjacent the top of said adjoining sidewall and wherein said lead-in surface and said curved contact surface merge into a rounded nose.

10. An electrical connector for interconnecting a plurality of insulation covered electrical conductors comprising an insulating housing and a plurality of contact elements of thin sheet metal construction mounted in the insulating housing, each contact element having a mating portion and a conductor termination portion, said termination portion including:

first and second wall sections and a base section integral with and extending between said wall sections to define an elongated channel;

first and second tabs extending from the upper edges of said first and second sidewall sections respectively, said tabs being folded along the top edges of the sidewalls and extending into opposing, substantially parallel relationship within said channel and extending downward toward said base section to define a pair of jaws for accepting and holding a conductor inserted therebetween.

11. An electrical connector according to claim 10 wherein said tabs include tapered surfaces extending between said sidewalls and said jaws to jointly define a downwardly converging lead-in region for the inserted conductor.

12. An electrical connector according to claim 11 wherein at least one of said tabs is shaped vertically along said jaw to define a curved wiping surface within said channel.

13. An electrical connector according to claim 12 wherein each of said tabs further includes a rounded transition area between said tapered lead-in surface and said curved wiping surface.

14. An electrical connector according to claim 10 wherein said base section has a cavity therein and wherein at least one of the free ends of said tabs extend into said cavity in abutting relationship to said base section.

15. An electrical connector according to claim 10 wherein the sidewall sections adjoining said tabs are flexible and wherein said connector is so formed as to allow limited lateral expansion of said elongated channel adjacent said tabs upon the insertion of a conductor into the channel.

16. An electrical connector according to claim 10 wherein each of said tabs includes a pair of wall portions, a curved wiping surface integral with and adjoining said wall portions, a tapered lead-in surface integral with said adjoining sidewall and extending downward into integral engagement with each of said wall portions and a rounded transition surface at the junction of said wall portions, said wiping surface and said lead-in surface.

17. An electrical connector according to claim 10 wherein the distance between said tabs is less than the diameter of the conductor prior to insertion thereof into the channel.

18. An electrical connector according to claim 12 wherein the respective wiping surfaces of said tabs are in spaced, downwardly converging relationship to one another.

19. A termination system for establishing and maintaining electrical contact with an insulation covered electrical conductor, said system comprising first and second sidewall members, means holding said sidewall members in spaced parallel relationship to define a cavity having at least one side open to receive a conductor inserted therein, at least one of said sidewall members having along its upper edge an integral extension thereof which is folded along the upper edge of said sidewall and into said cavity to make electrical contact with a conductor inserted into said cavity.

said extension including a substantially rigid rounded portion near said open side of the cavity for rupturing and separating the insulation from a conductor as it is inserted into the cavity.

20. A termination system according to claim 19 wherein said sidewall members are of thin conductive sheet metal and wherein said extension is defined by selective bends of said sheet metal.

21. A termination system for establishing and maintaining electrical contact with an insulation covered conductor, said system comprising:

first and second sidewall members of thin conductive sheet metal;

means holding said sidewall member in spaced parallel relationship to define a cavity therebetween having at least one side open to receive a conductor inserted therein;

at least one of said sidewall members having an integral extension thereof folded into said cavity for making electrical contact with a conductor upon insertion;

said integral extension including (a) a pair of wall portions converging together from the adjoining sidewall into a smooth curved wiping surface extending perpendicular to said cavity open side between said sidewall sections, and (b) a rounded portion defining the junction between said wall portions, said wiping surface and said adjoining sidewall near said open side of the cavity, said rounded portion extending upward into a continuous fold along the upper edge of the sidewall to define a tapered surface for guiding the conductor into the channel and a rigid rounded surface between said tapered surface and said wiping surface for rupturing and separating the insulation from the underlying conductor during insertion.

22. A termination system for establishing and maintaining electrical contact with an insulation covered electrical conductor, said system comprising first and second sidewall members of thin, conductive sheet metal, means holding said sidewall members in spaced parallel relationship to define a cavity having at least one side open to receive a conductor inserted therein, at least one of sidewall members having an integral portion thereof extending into said cavity to make electrical contact with a conductor inserted into said cavity, said extending portion having (a) a smooth, curved and continuous sheet metal surface extending downward from said sidewall into said channel to define a tapered lead-in surface for guiding the conductor into the cavity and (b) a rounded and continuous sheet metal surface bent to define a substantially rigid blunt nose near said open side of the cavity adjacent said lead-in surface for rupturing and separating the insulation from a conductor as the conductor is inserted into the cavity.

* * * * *

UNITED STATES PATENT AND TRADEMARK OFFICE

CERTIFICATE OF CORRECTION

PATENT NO. : 4,035,049

DATED : July 12, 1977

INVENTOR(S) : William H. McKee

It is certified that error appears in the above-identified patent and that said Letters Patent are hereby corrected as shown below:

Column 1, line 22, "shock" should read -- stock --.

Column 6, line 19, "nose" should read -- noses --. Column 6, line 56, "of" should read -- or --. Column 6, line 62, after "end" (first occurrence) delete -- of the end --. Column 9, line 5, after "cavity" change the period "." to a comma -- , --. Column 10, line 19, after "of" insert -- said --.

Signed and Sealed this

First Day of November 1977

[SEAL]

*Attest:*

RUTH C. MASON
*Attesting Officer*

LUTRELLE F. PARKER
*Acting Commissioner of Patents and Trademarks*